US007881638B2

(12) United States Patent
Noguchi et al.

(10) Patent No.: US 7,881,638 B2
(45) Date of Patent: Feb. 1, 2011

(54) DEVELOPING APPARATUS

(75) Inventors: Akihiro Noguchi, Toride (JP); Fumitake Hirobe, Ushiku (JP); Tadayoshi Nishihama, Abiko (JP); Akinori Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 630 days.

(21) Appl. No.: 11/691,113

(22) Filed: Mar. 26, 2007

(65) Prior Publication Data

US 2007/0231014 A1 Oct. 4, 2007

(30) Foreign Application Priority Data

Mar. 30, 2006 (JP) ..... 2006-096151

(51) Int. Cl.
*G03G 15/08* (2006.01)

(52) U.S. Cl. ..... 399/254; 399/256

(58) Field of Classification Search ..... 399/254, 399/256

See application file for complete search history.

(56) References Cited

U.S. PATENT DOCUMENTS

| | | | | |
|---|---|---|---|---|
| 5,819,132 | A | 10/1998 | Hirobe | |
| 5,963,766 | A * | 10/1999 | Okuno et al. | 399/256 |
| 6,442,355 | B2 | 8/2002 | Hasegawa et al. | |
| 6,603,943 | B2 * | 8/2003 | Yuuki et al. | 399/256 |
| 6,973,281 | B2 | 12/2005 | Hirobe et al. | |
| 6,975,825 | B2 | 12/2005 | Sakamaki et al. | |
| 6,993,274 | B2 | 1/2006 | Hirobe | |
| 7,054,583 | B2 | 5/2006 | Hirobe | |
| 7,054,584 | B2 | 5/2006 | Hirobe | |
| 7,099,609 | B2 | 8/2006 | Hirobe et al. | |
| 7,218,870 | B2 | 5/2007 | Hirobe | |
| 7,231,168 | B2 | 6/2007 | Hirobe | |
| 7,263,318 | B2 | 8/2007 | Nishihama et al. | |
| 7,463,852 | B2 * | 12/2008 | Yoshida et al. | 399/254 |
| 2006/0083554 | A1 | 4/2006 | Nishihama et al. | |
| 2006/0088341 | A1 | 4/2006 | Noguchi et al. | |
| 2006/0198661 | A1 | 9/2006 | Nishihama et al. | |
| 2007/0053720 | A1 | 3/2007 | Nishihama et al. | |

FOREIGN PATENT DOCUMENTS

| | | |
|---|---|---|
| JP | 9-197782 A | 7/1997 |
| JP | 9-258535 A | 10/1997 |

* cited by examiner

*Primary Examiner*—David M Gray
*Assistant Examiner*—Erika Villaluna
(74) *Attorney, Agent, or Firm*—Fitzpatrick, Cella, Harper & Scinto

(57) ABSTRACT

A developing apparatus includes a developer container for containing a developer; a first screw, provided in a first screw, provided in a first chamber in the developer container, for feeding the developer; a second screw, provided in a second chamber in the developer container, for feeding the developer in a direction opposite from that of the first screw; an opening through which the developer is moved between the first chamber and the second chamber; and a developer carrying member, provided in the first chamber, for carrying the developer to effect development of an electrostatic image. At least one of said first screw and said second screw has a multiple thread screw portion having a number n of threads and a thread pitch P. The opening is located downstream from the multiple thread screw portion in a developer feeding direction and extends from a downstream-side end of the multiple thread screw portion in the developer feeding direction toward an upstream side of the multiple thread screw portion in a length equal to or more than nP.

8 Claims, 6 Drawing Sheets

DEVELOPING APPARATUS

FIELD OF THE INVENTION AND RELATED ART

The present invention relates to a developing apparatus usable in an image forming apparatus for forming an image using an electrophotographic method or an electrostatic recording method, particularly suitable for an image forming apparatus such as a copying machine, a printer, a facsimile apparatus, or a multiple function machine having a plurality of these functions.

For example, as the electrophotographic method, various methods have been conventionally known. In these methods, an electrostatic image is formed by irradiating an electrophotographic photosensitive member, having an electroconductive layer, as an image bearing member with a light image corresponding to an original. Then, the electrostatic image is developed into a toner image by depositing colored fine powder called "toner" having a polarity opposite to that of the electrostatic image on the electrostatic image. Therefore, the toner image is transferred onto a transfer material such as paper or the like, as desired, and then is fixed by heat, pressure, solvent vapor, or the like to obtain a copied product or a printout.

In a step of developing the electrostatic image, image formation is effected by depositing electrically charged toner particles on the electrostatic image formed on the image bearing member by utilizing electrostatic interaction with the electrostatic image.

Generally, in such a developing method of developing the electrostatic image with a toner, a two-component developer, including the toner dispersed in a medium called a "carrier", is suitably used for a full-color copying machine and a full-color printer which are required to provide high image quality.

In order to perform good development in a developing apparatus using the two-component developer, it is required that a sufficient charged developer is uniformly supplied to a developing sleeve as a developer carrying member. In order to meet this requirement, a predetermined amount of the charged developer which has been sufficiently stirred is required to be stably supplied to the developing sleeve.

An embodiment of a developing apparatus capable of realizing the stable supply of developer has been described in Japanese Laid-Open Patent Application (JP-A) Hei 9-197782. This developing apparatus includes a developer carrying member disposed opposite to an image bearing member, a front-side stirring shaft disposed substantially parallel with an axial line of the developer carrying member and close to the developer carrying member, and a rear-side stirring shaft disposed apart from the developer carrying member. The two (front-side and rear-side) stirring shafts circulate and feed the developer while stirring the developer.

In a developing apparatus in which developer is fed from the front-side stirring shaft to the developer carrying member, at least one of the stirring shafts is a multiple thread screw member having a plurality of threads, constituted by a helical blade portion formed on the stirring shaft, disposed at a constant pitch (interval). By this constitution, the developer is intended to be uniformly fed to the developer carrying member.

Further, JP-A Hei 9-258535 discloses a developing apparatus in which a partition plate is disposed between a front-side feeding path provided with the front-side stirring shaft and a rear-side feeding path provided with the rear-side stirring shaft. The partition plate is provided with a first opening through which a two-component developer is fed from the front-side feeding path to the rear-side feeding path and a second opening through which the two-component developer is fed from the rear-side feeding path to the front-side feeding path. Further, both side wall portions facing the first and second openings are arcuately shaped to prevent stagnation of developer at the first and second openings and leakage of developer from the developing sleeve. Particularly, JP-A Hei 9-258535 is directed to solve such a problem that the developer is forcedly fed at a downstream end portion of the developing sleeve in a developer feeding direction, so that the developer leaking from the developing sleeve is considerably increased in amount at the downstream portion compared with an upstream end portion of the developing sleeve in the developer feeding direction.

Next, an embodiment of a developing apparatus will be described more specifically with reference to FIGS. 6-8.

In this embodiment, a developing apparatus 10 includes a housing, i.e., a developer container 11, to which a developing sleeve 13 as a developer carrying member is rotatably provided and located at an opening 12 opposing a photosensitive drum as an image bearing member. The developer container 11 includes a developing chamber 15 disposed close to the developing sleeve 13 and a stirring chamber 16 disposed apart from the developing sleeve 13. The developing chamber 15 and the stirring chamber 16 are separated or delimited by a partition wall 17.

In a first feeding path 21 formed in the developing chamber 15, a front-side stirring shaft, i.e., a first developer feeding member 31, is disposed substantially parallel with an axial line of the developing sleeve 13. Further, in a second feeding path 22 formed in the stirring chamber 16, a rear-side stirring shaft, i.e., a second developer feeding member 32, is disposed substantially parallel with the axial line of the developing sleeve 13. These two (first and second) developer feeding members 31 and 32 circulate and feed the developer in the developing chamber 15 and the stirring chamber 16, respectively, i.e., in the first feeding path 21 and the second feeding path 22, respectively, while stirring the developer.

Referring to FIG. 7, the partition wall 17 for delimiting the developing chamber 15 and the stirring chamber 16 is formed therebetween, i.e., between the first feeding path 21 and the second feeding path 22. Between both ends 17*a* and 17*b* of the partition wall 17 and associated side walls 18 and 19 of the housing 10, a first opening 23 and a second opening 24 are formed. The first opening 23 has the function of feeding the developer from the first feeding path 21 to the second feeding path 22 therethrough. Further, the second opening 24 has the function of feeding the developer from the second feeding path 22 to the first feeding path 21 therethrough.

Accordingly, the partition wall 17 is formed so that the first feeding path 21 and the second feeding path 22 communicate with each other through the first opening 23 and the second opening 24 only at both ends 17*a* and 17*b* of the partition wall 17. Portions of the first feeding path 21 and the second feeding path 22 between the first and second openings 23 and 24 are partitioned by the partition wall 17 so that a circulation path is formed via the portions of the first and second feeding paths 21 and 22 and the first and second openings 23 and 24 in the direction of arrows indicated in FIG. 7.

In the developing apparatus shown in FIG. 7, the first developer feeding member 31 is a multiple thread screw member (three-thread screw member in this embodiment), and the second developer feeding member 32 is a single thread screw member. Further, the first developer feeding member 31 and the second developer feeding member 32 are disposed in the first feeding path 21 and the second feeding path 22, respectively, as described above, so that the developer is fed in opposite directions by the first developer feeding member 31 and the second developer feeding member 32.

However, in such a conventional developing apparatus 10 described above, in the case where the partition wall 17 extends in a long length toward a downstream side of the first developer feeding member 31 as the multiple thread screw member, i.e., a space of the first opening 23 is small, the following problem occurs.

At the opening portion, a circulation of developer is out of balance, so that there is a possibility that stagnation of developer and overflow of developer from the developing sleeve 13 may occur.

Further, as described in JP-A Hei 9-258535, when the side wall 18 facing the developer opening 23 has an arcuate shape, a vector of a feeding direction is not constant although the effect is larger than that in the case of a planar side wall. For this reason, the balance of the vector of the feeding direction with returning of developer feeding direction by a developer-returning rotation blade 31*c* provided at an axial end portion of the first developer feeding member 31 is not achieved. As a result, the circulation balance of developer at the first opening 23 is not achieved, so that the stagnation of developer is not eliminated in some cases depending on an image density or a degree of agglomeration of developer. Further, a size of the developer container 11 is increased, so that the constitution is unrealistic for a current goal of space saving. This problem is also true for the second opening 24 in the case where the multiple thread screw member is employed as the second developer feeding member 32.

SUMMARY OF THE INVENTION

A principal object of the present invention is to provide a developing apparatus capable of preventing stagnation of a developer even when using a multiple thread screw member as a developer feeding member.

According to an aspect of the present invention, there is provided a developing apparatus comprising:

a developer container for containing a developer;

a first screw, provided in a first chamber in the developer container, for feeding the developer;

a second screw, provided in a second chamber in the developer container, for feeding the developer in a direction opposite from that of the first screw;

an opening through which the developer is moved between the first chamber and the second chamber; and a developer carrying member, provided in the first chamber, for carrying the developer to effect development of an electrostatic image, wherein at least one of the first screw and the second screw has a multiple thread screw portion having a number n of threads and a thread pitch P, and wherein the opening is located downstream from the multiple thread screw portion in a developer feeding direction and extends from a downstream-side end of the multiple thread screw portion in the developer feeding direction toward an upstream side of the multiple thread screw portion in a length equal to or more than nP.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the present invention will be described move specifically with reference to the drawings.

Embodiment 1

Figure 1:
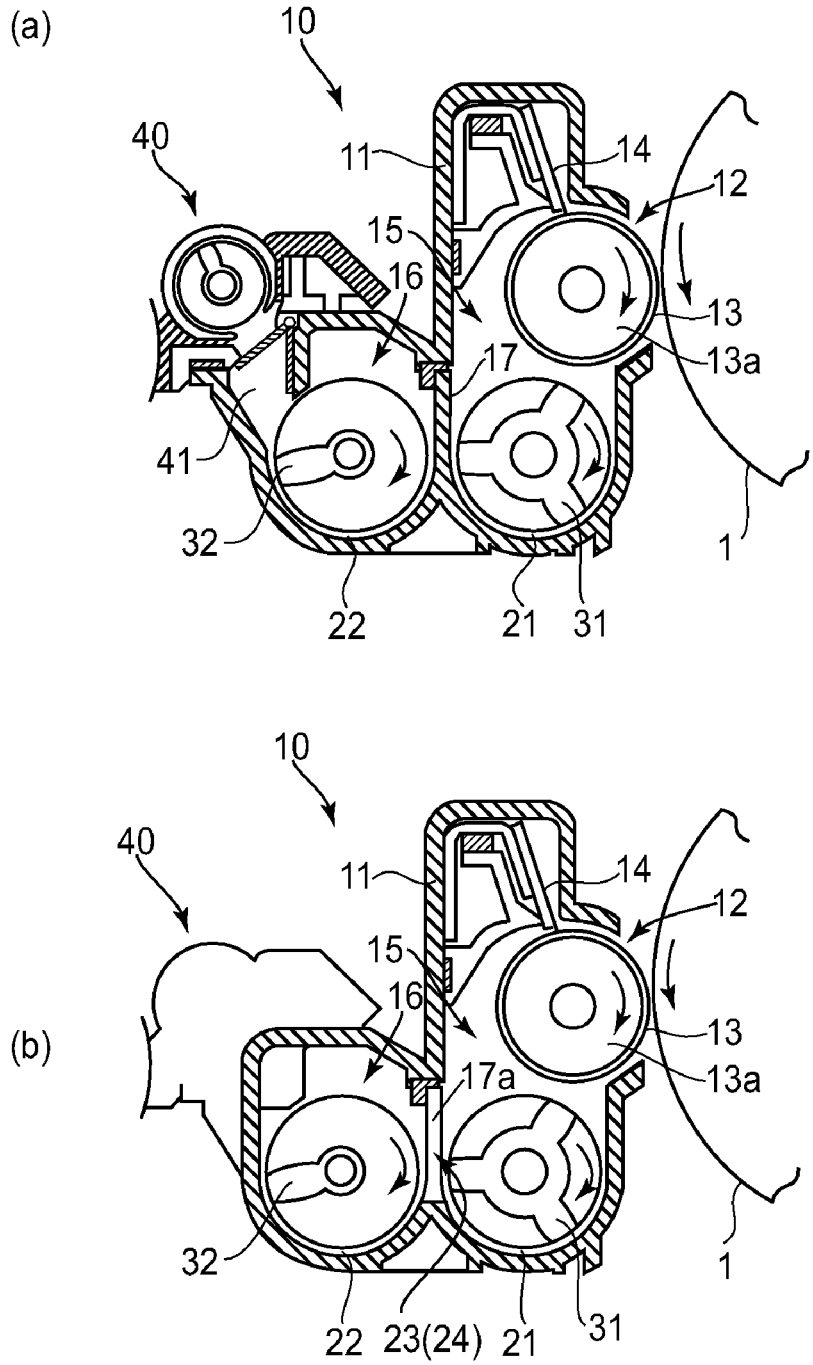
FIGS. 1(*a*) and 1(*b*) are schematic cross-sectional views illustrating an embodiment of the developing apparatus according to the present invention, wherein FIG. 1(*a*) is a sectional view along line a-a shown in FIG. 2, and FIG. 1(*b*) is a sectional view along line b-b shown in FIG. 2.

FIGS. 1(*a*) and 1(*b*) show a schematic constitution of an embodiment of the developing apparatus according to the present invention.

In the following description, dimensions, materials, and shapes of constituents of the developing apparatus and relative positions of these constituents, and the like are not limited to those specifically described unless otherwise noted specifically.

Figure 6:
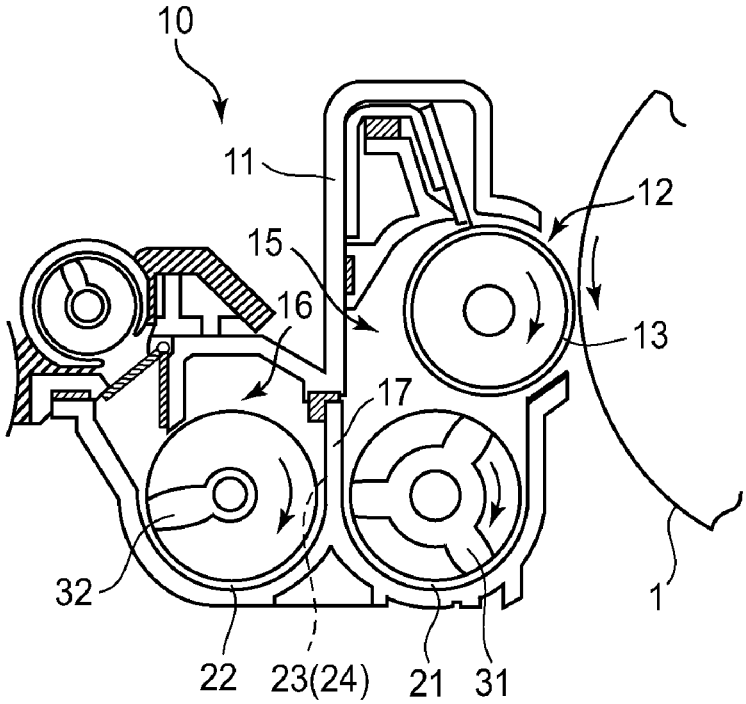
FIG. 6 is a schematic cross-sectional view showing an embodiment of a conventional developing apparatus.
Figure 8:
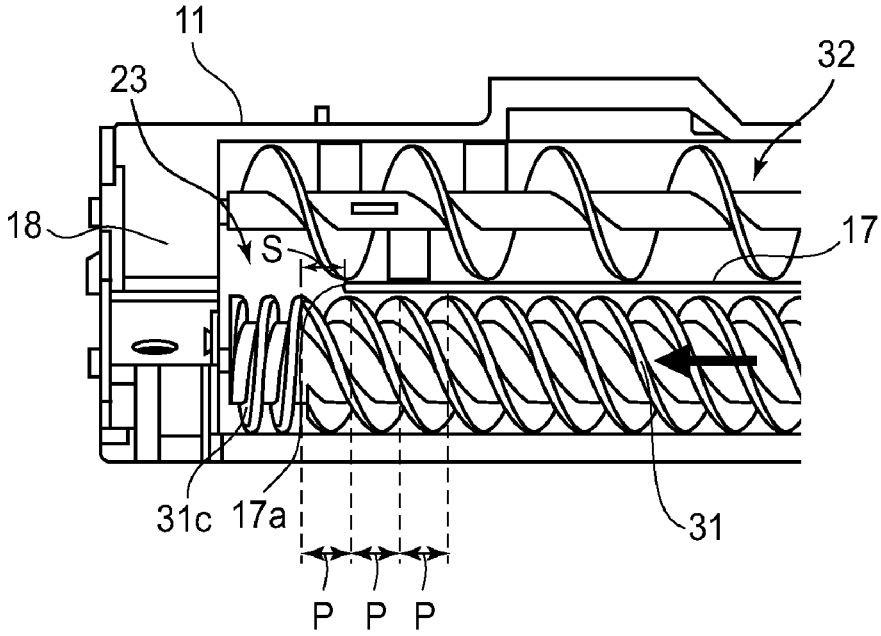
FIG. 8 is an enlarged view of a portion C of the developing apparatus shown in FIG. 7.
Figure 7:
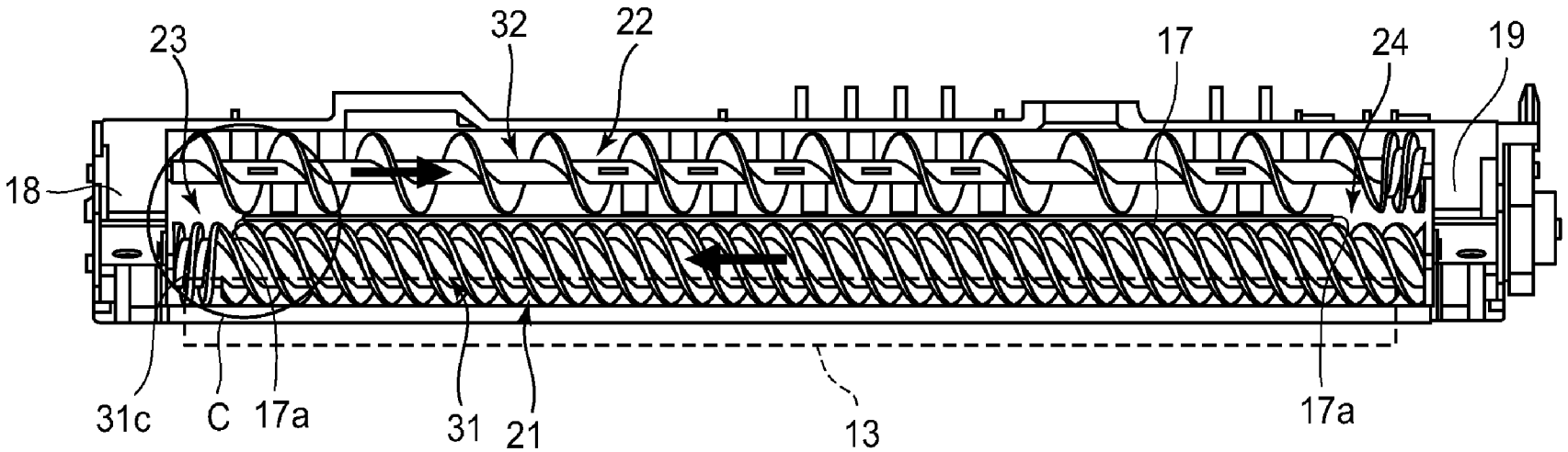
FIG. 7 is a schematic plan view for illustrating a relationship among developer feeding members, openings, and a partition wall of the conventional developing apparatus.

In this embodiment, the developing apparatus has the same general constitution as that of the conventional developing apparatus described above with reference to FIGS. 6-8.

Figure 2:
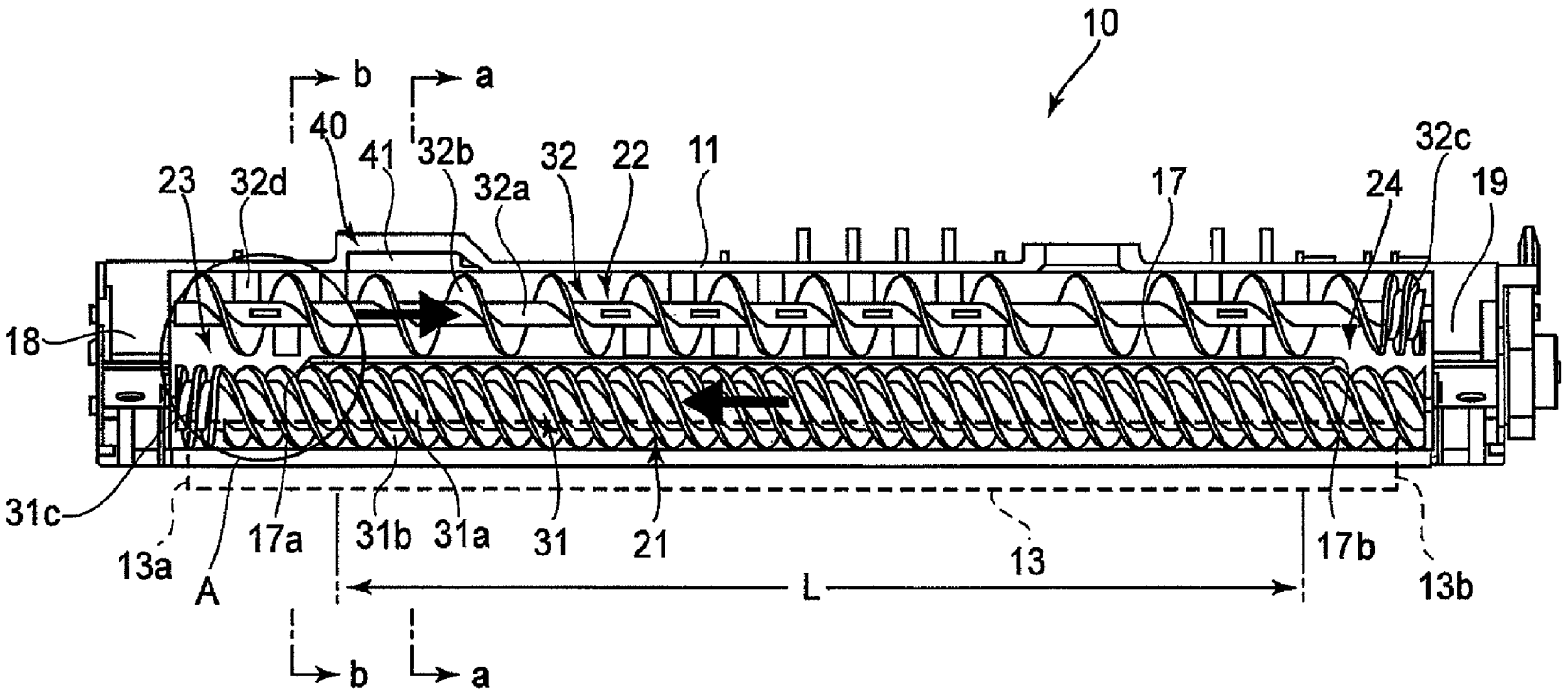
FIG. 2 is a schematic plan view for illustrating a relationship among developer feeding members, openings, and a partition wall in an embodiment of the developing apparatus of the present invention.
Figure 3:
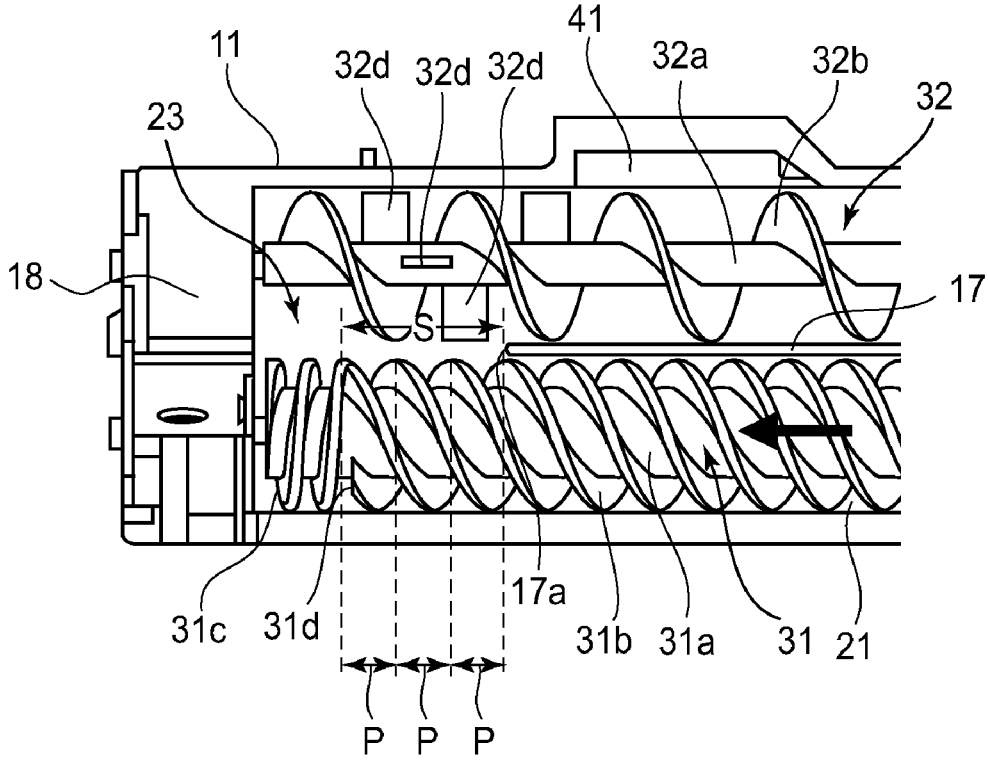
FIG. 3 is an enlarged view of a portion A of the developing apparatus shown in FIG. 2.

More specifically, referring to FIGS. 1(*a*) and 1(*b*) and FIGS. 2 and 3, a developing apparatus 10 includes a housing, i.e., a developer container 11. The developer container 11 is provided with an opening 12 at a position opposite to a drum-like electrophotographic photosensitive member, i.e., a photosensitive drum 1 as an image bearing member. At the opening 12, a developing sleeve 13 as a developer carrying member is rotatably held opposite to the photosensitive drum 1. Inside the developing sleeve 13, a magnet roller 13*a* as a magnetic field generation means is disposed. In this embodiment, a two-component developer including a magnetic carrier and a toner is accommodated in the developer container 11.

Further, a developer thickness regulation member for regulating an amount of developer to be carried and fed to the developing sleeve 13, i.e., a doctor blade 14 is disposed close to an upper end of the opening 12 of the developer container 11.

The developer container 11 includes therein a developing chamber 15 disposed close to the developing sleeve 13 and a stirring chamber 16 disposed close to the developing chamber 15 but apart from the developing sleeve 13. The developing chamber 15 and the stirring chamber 16 are separated or delimited by a partition wall 17. In this embodiment, a developer supply roller 40 of a developer supply apparatus for supplying supply developer is disposed in the developing apparatus 10 and is provided with a supply opening 41 which communicates with the stirring chamber 16.

In a first feeding path 21 formed in the developing chamber 15, a first developer feeding member 31 is disposed substantially parallel with an axial line of the developing sleeve 13. Further, in a second feeding path 22 formed in the stirring chamber 16, a second developer feeding member 32 is disposed substantially parallel with the axial line of the developing sleeve 13. These (first and second) developer feeding members 31 and 32 rotate in a direction of indicated arrows (clockwise direction) and circulate and feed the developer in the first feeding path 21 and the second feeding path 22, respectively, while stirring the developer.

The partition wall 17 for delimiting the developing chamber 15 and the stirring chamber 16 is formed between the first feeding path 21 and the second feeding path 22. At portions adjacent to both ends 17*a* and 17*b* of the partition wall 17, a first opening 23 and a second opening 24 are formed, respectively. In other words, between the two ends 17*a* and 17*b* of the partition wall 17 and associated side walls 18 and 19 of the developer container 11, the first opening 23 and the second opening 24 are formed, respectively. The first opening 23 has the function of feeding the developer from the first feeding path 21 to the second feeding path 22 therethrough. Further, the second opening 24 has the function of feeding the developer from the second feeding path 22 to the first feeding path 21 therethrough.

Accordingly, the partition wall 17 is formed as that the first feeding path 21 and the second feeding path 22 communicate with each other through the first opening 23 and the second opening 24 only at both ends 17*a* and 17*b* of the partition wall 17. By this constitution, the first feeding path 21 and the second feeding path 22 form a circulation path of developer in the developer container 11. Accordingly, the developer is circulated in a direction of arrows indicated in FIG. 2 while being stirred in the first feeding path 21 and the second feeding path 22 in the developer container 11.

As shown in FIG. 2, the first developer feeding member 31 and the second developer feeding member 32 are constituted so that the developer is fed in opposite directions in the first feeding path 21 and the second feeding path 22.

Next, the first developer feeding member 31 and the second developer feeding member 32 will be described.

In this embodiment, each of the first developer feeding member 31 and the second developer feeding member 32 is an integral screw member including a rotation shaft 31*a* or 32*a* and a rotation blade 31*b* or 32*b* helically mounted to the rotation shaft. At least one of the first developer feeding member 31 and the second developer feeding member 32 is a multiple thread screw member provided with a multiple-thread helical rotation blade. In this embodiment, the first developer feeding member 31 disposed in the first feeding path 21 is a multiple thread screw member (three-thread screw member in this embodiment), and the second developer feeding member 32 disposed in the second feeding path 22 is a single-thread screw member.

Further, in this embodiment, as shown in FIG. 2, a helical developer-returning rotation blade 31*c* opposite in helical direction to a helical rotation blade 31*b* is formed at an end portion of the first developer feeding member 31 on the first opening 23 side, i.e., at a downstream end portion of the first developer feeding member 31, in a developer feeding direction. Similarly, at an end portion of the second developer feeding member 32 on the second opening 24 side, i.e., at a downstream and portion of the second developer feeding member 32 in the developer feeding path, a helical developer-returning rotation blade 32*c* opposite in helical direction to a helical rotation blade 32*b* is formed. These developer-returning rotation blades 31*c* and 32*c* cause the developer fed by the rotation blades 31*b* and 32*b* of the first and second developer feeding members 31 and 32 to enter the first and second openings 23 and 24 through the first and second feeding paths 21 and 22, respectively.

Further, in this embodiment, in order to efficiently perform stirring of the developer during the feeding of the developer in the second feeding path 22, the second developer feeding member 32 is provided with stirring projections 32*d* each extending from the rotation shaft 32 in a radial direction are provided along an axial line of the rotation shaft 32. Each of the stirring projections 32*d* can be disposed in a rotational direction of the rotation shaft with a different phase. In this embodiment, the stirring projections 32 are provided with a phase difference of 90 degrees between adjacent projections.

Next, a sequence of feeding and circulation of developer will be described.

As described above, the developer in the first feeding path 21 is circulated in the indicated arrow direction by the first developer feeding member 31 and fed to the adjacent second feeding path 22 through the first opening 23 provided on the downstream side of the first feeding path 21 in the developer feeding direction.

In this embodiment, as shown in FIG. 3 in an enlarged state, the first developer feeding member 31 is the multiple thread screw member. In the present invention, the number of threads of the multiple thread screw member 31 is taken as n and a pitch (interval) of each rotation blade in an axial direction of the multiple thread screw member 31 is taken as P.

In this embodiment, the first opening 23 located at the downstream portion of the first feeding path 21, in the developer feeding direction, in which the first developer feeding member 31 as the multiple thread screw member is formed in the following manner. More specifically, the first opening 23 extends from a downstream end 31*d* of the multiple thread screw member 31 in the developer feeding direction toward an upstream side of the multiple thread screw member 31 in the developer feeding direction in a length or distance (S) equal to or more than nP in the axial direction of the multiple thread screw member 31.

In this embodiment, the multiple thread screw member 31 (the first developer feeding member) is the three-thread screw member as described above, so that the first opening 23 extends in a length of 3 P or more. Further, in this embodiment, as described above, the first developer feeding member 31 is provided with the developer-returning rotation blade 31*c* at the end portion thereof. Accordingly, as shown in FIG. 3, the first opening 23 extends in a length or distance of not less than the distance (S) ranging from a position of an end 27*a* of the partition wall 17 in a longitudinal direction of the partition wall 17 to a position of the end 31*d* of the multiple thread screw member (i.e., a position from which the developer-returning blade 31*c* is provided).

As described above, in this embodiment, the distance (S) is taken as a value of not less than the length (nP). On the other hand, as is understood from FIG. 8, the distance (S) in the conventional developing apparatus is merely one pitch (P) at the most.

As described above, according to this embodiment, a developer feeding portion from the first developer feeding member 31 to the second developer feeding member 32, i.e., the first opening 23, extends from the developer feeding path downstream end 31*d* of the multiple thread screw member 31 toward the developer feeding path upstream side of the multiple thread screw member 31 in the length (distance) (S) of not less than nP in the axial line direction of the multiple thread screw member 31. As a result, it is possible to effect smooth feeding of the developer.

However, according to a study by the present inventors, in the case where the length (S) is more than 2 nP (i.e., S>2 nP), circulation of developer becomes out of balance. As a result, it has been found that the developer remains or stagnates in the neighborhood of the side wall 18 to result in image failure such as a decrease in image density at an end portion of an image forming area.

Further, in the case where the first opening 23 extends in the distance (S) of more than 2nP such that the supply opening 41 is provided in the neighborhood of the first opening 23, as in this embodiment, the developer feeding portion extends to the supply opening 41. In such an arrangement, the supply developer, supplied through the supply opening 41, which is ordinarily stirred and fed in the second feeding path 22 in the indicated arrow direction and circulated in the first feeding path 21 and then is not fed to the developing sleeve 13, is at least partially moved immediately in the first feeding path 21 and fed to the developing sleeve 13. As a result, the fed supply developer leads to fog or an irregularity in image density.

Accordingly, the first opening 23 may preferably extend in a distance (S) of nP or more and 2 nP or less, i.e., $nP \leqq S \leqq 2nP$.

In this embodiment, as shown in FIG. 2, longitudinal both end portions 13*a* and 13*b* of the developing sleeve 13 in an axial direction of the developing sleeve 13 may preferably be located at positions corresponding to the first opening 23 and the second opening 24, respectively. In this case, both end portions of a developing area (L) of the developing sleeve 13 for developing an electrostatic image formed on the photosensitive drum 1 may preferably be located inside the two ends 17*a* and 17*b* of the partition wall 17. This is because when movement of developer in a chamber to an adjacent chamber occurs in the developing area (L) contributing to development, there is a possibility of an occurrence of image failure resulting from an occurrence of an irregularity in developer carrying performance or an irregularity in triboelectric charge of developer. The developing area (L) in this case is an area, of the developing sleeve, opposite to an image forming area, in which an electrostatic image of a maximum size can be formed by an image forming apparatus.

According to the above-constituted developing apparatus of this embodiment, it is possible to prevent an insufficient image density or an irregularity in image density on an image forming surface. Further, it is possible to obtain a good quality image which is free from overflow of developer from the developing sleeve 13 and screw locking.

In this embodiment, the first opening 23 in the case where the first developer feeding member 31 is the multiple thread screw member is described. However, in the case where the second developer feeding member 32 is the multiple thread screw member, a similar constitution is employed also in the second opening 24, so that the same action and effect as in the case of the first opening 23 can be achieved.

Further, a principle of the present invention is similarly applicable to the case where both of the first and second developer feeding members 31 and 32 are multiple thread screw members and is capable of achieving similar action and effect.

Further, the constitutions and the like of the developer and the developing apparatus in this embodiment are not limited to those described in this embodiment but the present invention is also applicable to various constitutions of the developer and the developing apparatus. More specifically, a size of the opening, the number of threads of the screw member as the developer feeding member, and the like are not limited to those described in this embodiment.

Embodiment 2

A second embodiment of the developing apparatus according to the present invention will be described with reference to FIGS. 4 and 5.

Also in this embodiment, the general constitution and function of the developing apparatus can be the same as in Embodiment 1. For this reason, members having the same constitution and function as those in Embodiment 1 are represented by the same reference numerals or symbols and redundant explanation thereof will be omitted.

The developing apparatus in this embodiment is increased in developer feeding speed so as to meet an increase in process speed of an image forming apparatus resulting from an increase in output speed of the image forming apparatus.

In order to maintain a developer feeding ability in the case where the process speed of the image forming apparatus is increased, in the developing apparatus similar to that in Embodiment 1, the number of rotations of the developer feeding member is required to be increased in correspondence with the increase in process speed. For this reason, in this embodiment, as a result of the increase in process speed, the rotation speeds of the first developer feeding member 31 and the second developer feeding member 32 are also increased.

In this condition, in the constitution of Embodiment 1, the developer circulation through the first opening 23 as the developer feeding portion cannot be performed smoothly in some cases.

Figure 5:
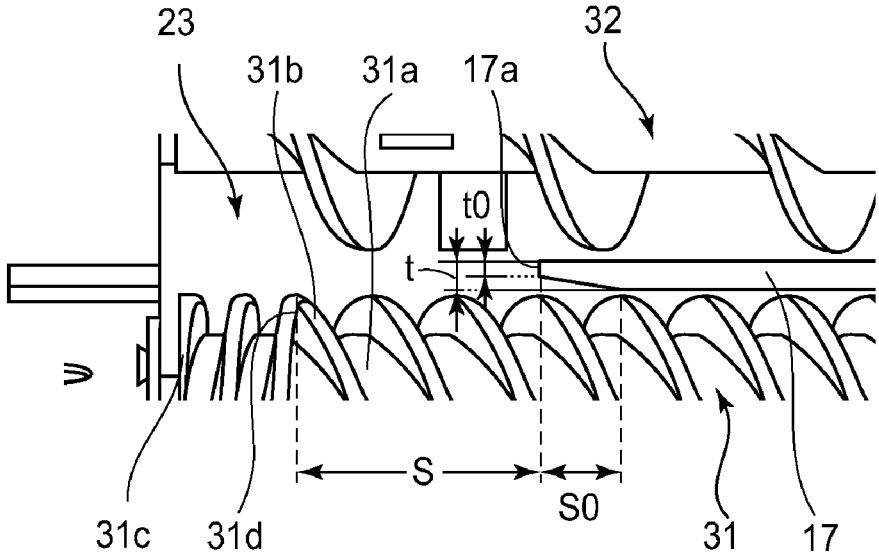
FIG. 5 is an enlarged view of a portion B of the developing apparatus shown in FIG. 4.
Figure 4:
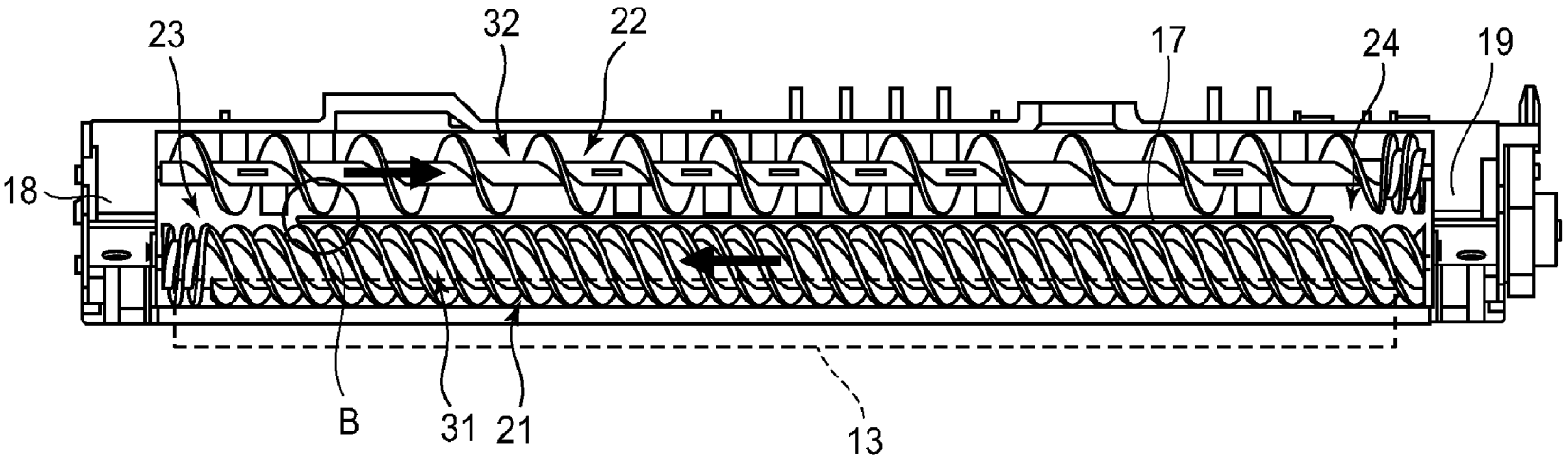
FIG. 4 is a schematic plan view for illustrating a relationship among developer feeding members, openings, and a partition wall in another embodiment of the developing apparatus of the present invention.

In view of this, in this embodiment, as shown in FIGS. 4 and 5, the partition wall 17 is tapered in an area S0 on the first feeding path 21 side at the developer feeding direction downstream end portion of the partition wall 17 in the first feeding path 21. In other words, in the developer feeding direction downstream-side end area S0 of the partition wall 17 in the first feeding path 21, the thickness of the partition wall 17 is gradually decreased from an inner portion of the partition wall 17 toward the first opening 23. By this arrangement, it is possible to smoothly feed the developer from the first feeding path 21 to the first opening 23. In this embodiment, the cross-sectional shape of the partition wall 17 in the area S0 is different from that at the inner portion of the partition wall. More specifically, the partition wall 17 has a smaller thickness at its end portion than at its central portion such that a width in a horizontal direction of the first feeding path 21 provided with the first developer feeding member 31 can be increased toward the developer feeding direction downstream-side end 17*a* of the partition wall 17.

In this embodiment, the tapered area S0 on the first feeding path 21 side at least changes length of a minimum pitch (P) of the first developer feeding member 31 and the cross section of the partition wall 17. In this embodiment, a minimum thickness (t0) of the partition wall at the developer feeding direction downstream-side end 17*a* is ½ of a thickness (t) of the partition wall 17 (i.e., $t0=(1/2)t$).

However, the present invention is not limited thereto. In a preferred embodiment, a maximum length of the tapered area (S0) having the changed cross section of the partition wall 17 is (nP) to (3 nP), i.e., $P \leqq S0 \leqq (nP \text{ to } 3\ nP)$. Further, the minimum thickness (t0) of the partition wall 17 at its downstream-side end 17*a* can be in the range from (1/5)t to (4/5)t, i.e., $(1/5)t \leqq t0 < (4/5)t$.

As a result, the process speed is increased, so that it is possible to prevent an occurrence of insufficient image density portion or irregular image density portion on the image forming surface even when the rotation numbers of the first and second developer feeding members 31 and 32 are increased.

Further, the arrangement and the like of the developer and the developing apparatus used in this embodiment are not limited to those described in this embodiment but the present invention is also applicable to constitutions of various developers and developing apparatuses. More specifically, the cross section of the partition wall 17 is not limited to the tapered shape but also can be a stepped shape or an arcuate shape. Further, the number of threads of the helical rotation blade as the developer feeding member is also not limited to that in this embodiment.

In this embodiment, the end portion of the partition wall 17 on the first opening 23 side in the case where the first developer feeding member 31 is the multiple thread screw member is described. However, in the case where the second developer feeding member 32 is the multiple thread screw member, a similar constitution is employed also at an end portion of the partition wall 17 on the second opening 24 side, so that the same action and effect as in the case of the first opening 23 can be achieved.

Further, a principle of the present invention is similarly applicable to the case where both of the first and second developer feeding members 31 and 32 are multiple thread screw members and is capable of achieving similar action and effect.

Further, the constitutions and the like of the developer and the developing apparatus in this embodiment are not limited to those described in this embodiment but the present invention is also applicable to various other constitutions of the developer and the developing apparatus. More specifically, a size of the opening, the number of threads of the screw member as the developer feeding member, and the like are not limited to those described in this embodiment.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 096151/2006 filed Mar. 30, 2006, which is hereby incorporated by reference.

What is claimed is:

1. A developing apparatus comprising:

a first chamber, provided with an opening, for containing a developer;

a second chamber for forming a circulating path with said first chamber through the opening;

a first feeding member for feeding the developer contained in said first chamber;

a second feeding member for feeding the developer contained in said second chamber; and a developer carrying member, provided in said first chamber, for carrying the developer to a developing position in which said developer carrying member opposes an image bearing member, thereby to develop an electrostatic image formed on the image bearing member, wherein at least one of said first feeding member and said second feeding member has a multiple thread screw portion having a number of threads n and a thread pitch P, and wherein said opening opposes the multiple thread screw portion and extends from a most downstream end position of the multiple thread screw portion with respect to the developer feeding direction of the multiple thread screw portion toward an upstream side of the multiple thread screw portion in a length of at least nP.

2. An apparatus according to claim 1, wherein said opening extends in a length of nP or more and 2 nP or less with respect to the developer feeding direction of the multiple thread screw portion.

3. An apparatus according to claim 1, wherein the developer includes a toner and a carrier.

4. An apparatus according to claim 1, wherein said developer carrying member has longitudinal end portions, in the developer feeding direction, one end portion being located at a position opposite to the opening.

5. An apparatus according to claim 4, further comprising a partition wall for partitioning said first chamber and said second chamber, wherein both longitudinal end portions of said partition wall are located outside a developing area with respect to an axial direction of said developer carrying member.

6. An apparatus according to claim 1, wherein at least one of said first feeding member and said second feeding member having the multiple thread screw portion has a developer returning screw portion on a downstream side from the multiple thread screw portion in the developer feeding direction.

7. An apparatus according to claim 6, wherein the developer returning screw portion is located close to the opening located downstream from the multiple thread screw portion in the developer feeding direction.

8. An apparatus according to claim 1, further comprising a partition wall for partitioning said first chamber and said second chamber, wherein the multiple thread screw portion is provided as a portion of said first feeding member, and wherein said partition wall has a shape with a thickness, at a downstream side end portion thereof, smaller than that at a central portion thereof so as to increase a width of said first chamber in a horizontal direction at the downstream side end portion of said partition wall.

* * * * *